US011866944B2

(12) United States Patent
Griffith, III

(10) Patent No.: US 11,866,944 B2
(45) Date of Patent: Jan. 9, 2024

(54) GUTTER INSTALLATION TOOL

(71) Applicant: Jack Conley Griffith, III, Centerburg, OH (US)

(72) Inventor: Jack Conley Griffith, III, Centerburg, OH (US)

( * ) Notice: Subject to any disclaimer, the term of this patent is extended or adjusted under 35 U.S.C. 154(b) by 2 days.

(21) Appl. No.: 17/885,045

(22) Filed: Aug. 10, 2022

(65) Prior Publication Data

US 2023/0050859 A1 Feb. 16, 2023

Related U.S. Application Data

(60) Provisional application No. 63/231,757, filed on Aug. 11, 2021.

(51) Int. Cl.
*E04D 15/00* (2006.01)
*E04D 13/064* (2006.01)

(52) U.S. Cl.
CPC ..... *E04D 15/00* (2013.01); *E04D 13/064* (2013.01)

(58) Field of Classification Search
CPC . E04D 15/00; E04D 13/0722; E04D 13/0725; E04D 13/068
USPC ..... 269/41, 3, 6
See application file for complete search history.

(56) References Cited

U.S. PATENT DOCUMENTS 4,874,123 A * 10/1989 Mercer, II ..... B25C 3/008 227/147
5,007,224 A * 4/1991 Segneri ..... B25C 1/02 52/741.1
5,873,568 A * 2/1999 Mayfield ..... B25B 7/22 269/6
2005/0016076 A1 1/2005 Spradlin
2019/0376294 A1 12/2019 Williams

FOREIGN PATENT DOCUMENTS

JP 08209871 A * 8/1996
JP 2012117269 A * 6/2012

* cited by examiner

*Primary Examiner* — Babajide A Demuren

(57) ABSTRACT

A tool that permits a length of rain gutter to be positioned and adjusted along an eave of a building. In one example, the tool includes a grasping portion for securing the device between a fascia and a wall, and a support portion for supporting a gutter when the gutter is being installed. The tool is easily secured to a building without the use of fasteners, clips, or the like, and allows a saddle to be provided for a portion of the gutter, where the saddle is adjustable in three dimensions relative to a mounting surface for the gutter.

18 Claims, 7 Drawing Sheets

GUTTER INSTALLATION TOOL

CROSS-REFERENCE TO RELATED APPLICATIONS

This application is entitled to the benefit of a right of priority from U.S. Provisional Application No. 63/231,757, filed on Aug. 11, 2021. The content of that application is incorporated by reference as if fully recited herein.

TECHNICAL FIELD

The disclosed invention relates to a tool that permits a length of rain gutter to be positioned and adjusted along an eave of a building. A single tool having the inventive concept may be used, but it is preferred to use at least two of the tools simultaneously.

BACKGROUND OF THE ART

Rain gutters, or, more familiarly, gutters, are installed along edges of a roof to collect water that runs off of the roof. Since the edge along which a gutter is run may be quite long, for example not by way of limitation, in excess of 60 feet, the installer may have tremendous difficulty with maintaining the gutter in a desired position during installation of the gutter. To prevent leakage, it is always desirable to make the gutter "seamless," which may be achieved by custom producing the gutter at the site using a brake, or by providing long portions of gutter with a minimal number of joints. In either case, most lengths of gutter are unwieldy for an individual to handle, and troublesome even to a pair of installers.

US published application 2019/0376294 also recognizes this problem, but takes a different approach to solving it. In that application, the inventive device is a support trough into which a length of gutter may be placed. The support may have one or two additional lengths of the support that telescope into a primary portion of the support, allowing the overall length of the support to be adjusted. While this device may be useful in raising a length of gutter up to the height where it is to be installed, the device does not appear to provide a tool that allows the length of gutter to be held in place against the building while an installer attaches the gutter to the building, as with conventional gutter hangers.

As a result, there is an unmet need in the prior art to provide a tool that is easily secured to a building without the use of fasteners, clips, or the like, and which allows a saddle to be provided for a portion of the gutter, where the saddle is adjustable in three dimensions relative to a mounting surface for the gutter.

SUMMARY

This and other unmet needs of the prior art are provided by a device as described in more detail below, as well as by a method of using at least one of the tools while installing a section of gutter.

In one embodiment, a device for installing a length of rain gutter ("tool") comprises a grasping portion. The grasping portion may comprise a first fin and a second fin. The grasping portion may further comprise a scissors apparatus positioned between the first fin and the second fin. The scissors apparatus may comprise a plurality of arms in rotational communication with one another. The scissors apparatus may be configured to permit the first and second fins to be positioned at any number of lengths from one another to immobilize the grasping portion beneath an eave. The device of the aforementioned one embodiment also comprises a support portion. The support portion may comprise a platform, a horizontal gutter positioning apparatus, and a height adjustment apparatus. The support portion may be linked to and adapted to extend outwardly from the grasping portion away from the scissors apparatus. The height adjustment apparatus may be configured to allow the height of the platform and the horizontal gutter positioning apparatus to be adjusted. The platform and horizontal gutter positioning apparatus may be configured to contact and immobilize the length of rain gutter.

In one embodiment, a method for installing a length of rain gutter comprises securing a grasping portion of a device for installing a length of rain gutter beneath an eave. The grasping portion may comprise a first fin, a second fin, and a scissors apparatus positioned between the first fin and the second fin, wherein the scissors apparatus may include a plurality of arms in rotational communication with one another. Securing the grasping portion may comprise positioning the scissors apparatus to connect the first fin to a vertical wall and the second fin to a fascia. The method of the aforementioned one embodiment further comprises positioning a portion of the length of rain gutter within a support portion of the device for installing a length of rain gutter. The support portion may comprise a platform, a horizontal gutter positioning apparatus, and a height adjustment apparatus. The support portion may be linked to and adapted to extend outwardly from the grasping portion away from the scissors apparatus. The height adjustment apparatus may permit the platform and horizontal gutter positioning apparatus to be positioned at any number of heights. The method of the aforementioned one embodiment further comprises immobilizing the length of rain gutter within the support portion. Immobilization of the length of rain gutter within the support portion may be achieved by maintaining the portion of the length of the rain gutter between the platform, the positioning apparatus, and the fascia. The method of the aforementioned one embodiment further comprises attaching the length of rain gutter to the eave.

A single exemplary tool may be used, but it is preferred to use at least two of the tools simultaneously.

Exemplary embodiments may be useful for installing a length of rain gutter beneath an eave without the need for fasteners, clips, or the like for securing the tool. Exemplary embodiments may include a saddle adapted to be adjusted in three dimensions to immobilize a portion of the gutter for installation and/or maintenance thereof.

BRIEF DESCRIPTION OF THE DRAWINGS

The invention will be better understood when reference is made to drawings, where identical parts are identified by identical reference numbers and where.

DETAILED DESCRIPTION OF THE DRAWINGS

In the following explanation of the invention, certain terms relating to architectural features of a building will be used. For purposes of definiteness, these terms are defined here. In many buildings, the rafters that comprise a sloped roof extend beyond a vertical wall of the building, forming an "eave" or "overhang." At the outer end of the rafters, a vertical board, the "fascia" spans the rafter ends. The material providing a horizontal surface on the underside of the eave, between the fascia and the vertical wall of the building, is known as the "soffit." In many cases, this soffit is mounted into channels provided on the interior side of the fasci and the exterior side of the vertical wall.

When a length of rain gutter is installed, it needs to be held in place against an exterior face of the fascia during the fastening process. Even when a relatively short section of gutter is being installed, an installer, working alone, will be hard pressed to hold the section and fasten the section to the fascia using conventional gutter hangers. Typically, multiple people are needed to install a gutter using tools available in the prior art.

The tool employing the inventive concept may be used by itself. However, it will be preferred to use at least two of the tools. Since the tools are easily positioned and removed, without the use of fasteners, clips, or the like, two of the tools, by being moved from position to position, may actually replace what would have required two or three installers in the prior art methods.

Beyond those advantages, the tool is designed to permit precise positioning of the gutter in three dimensions at the location of the tool. This provides an advantage not known in the prior art where a person was used to manually maintain a position of the gutter. The tool may also be mounted on most eaves without using fasteners, so there is no trace left of its use.

The tool may take the place of a person holding the gutter up by hand until it is fastened, and, while a single tool may be used, it is expected that using two or more of the tool may provide the best results. When at least two tools are used, one person may install a large section of gutter by themselves.

Figure 6:
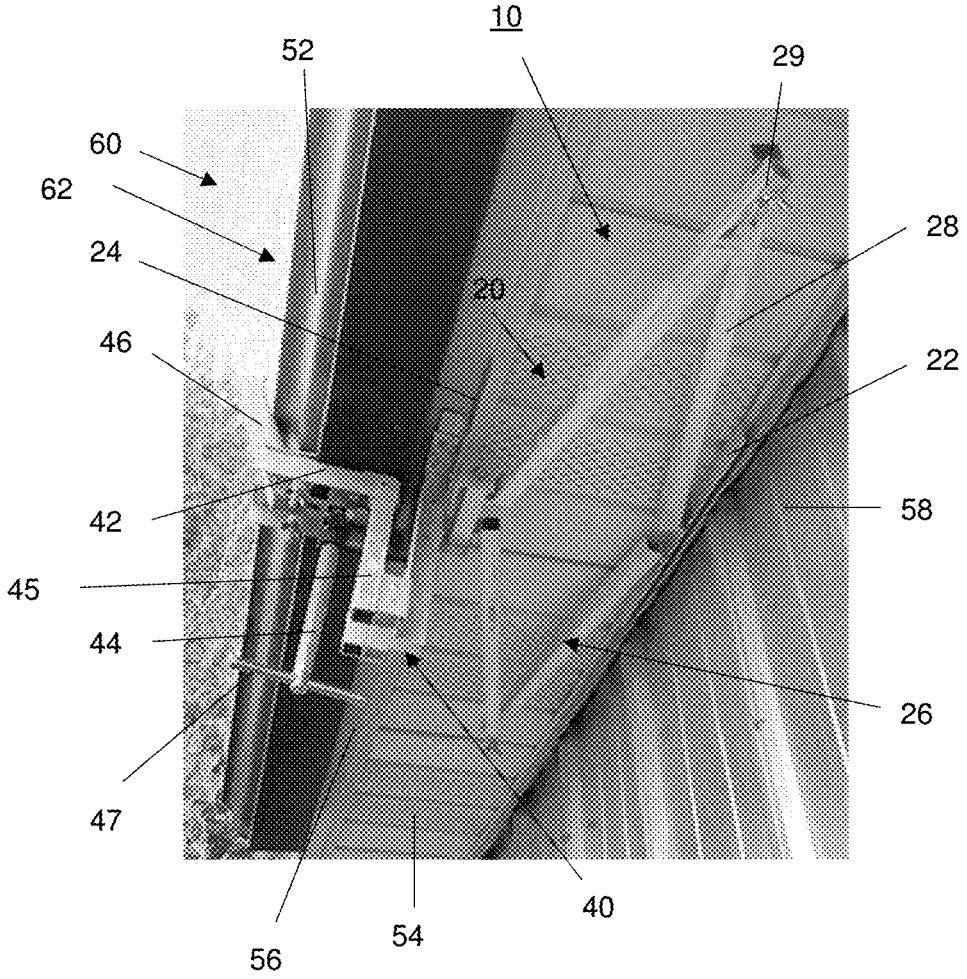
FIG. 6 is bottom front perspective view of the FIG. 1 tool in active engagement with a building during the hanging of a gutter.
Figure 7:
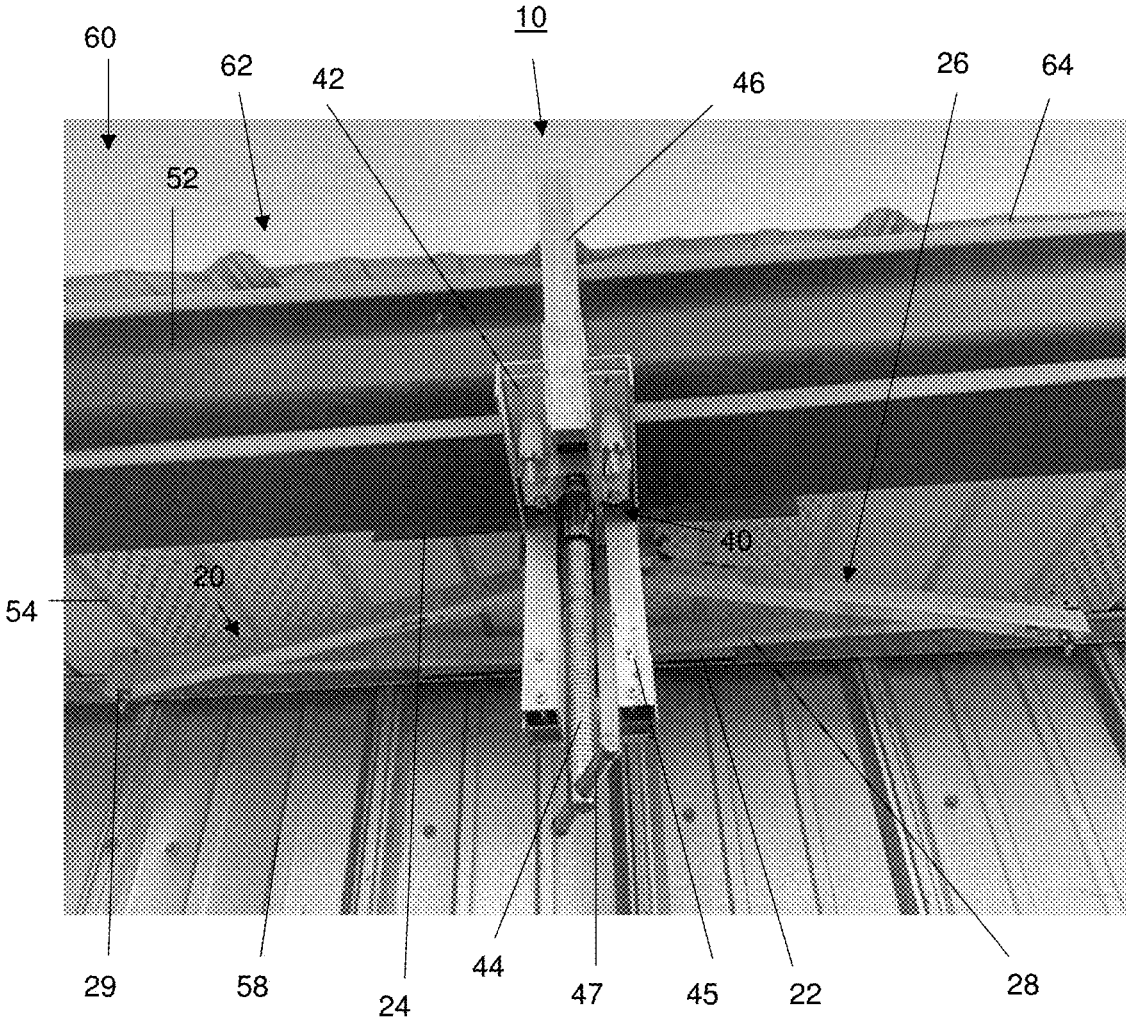
FIG. 7 is a further bottom front perspective view of the FIG. 1 tool in active engagement with building during the hanging of a gutter.

FIGS. 1 through 5 show an embodiment 10 of the gutter hanging tool of the inventive concept in various views, isolated from a building or a gutter. FIGS. 6 and 7 provide a pair of views in which the tool 10 is depicted during the installation of a gutter 52.

Figure 1:
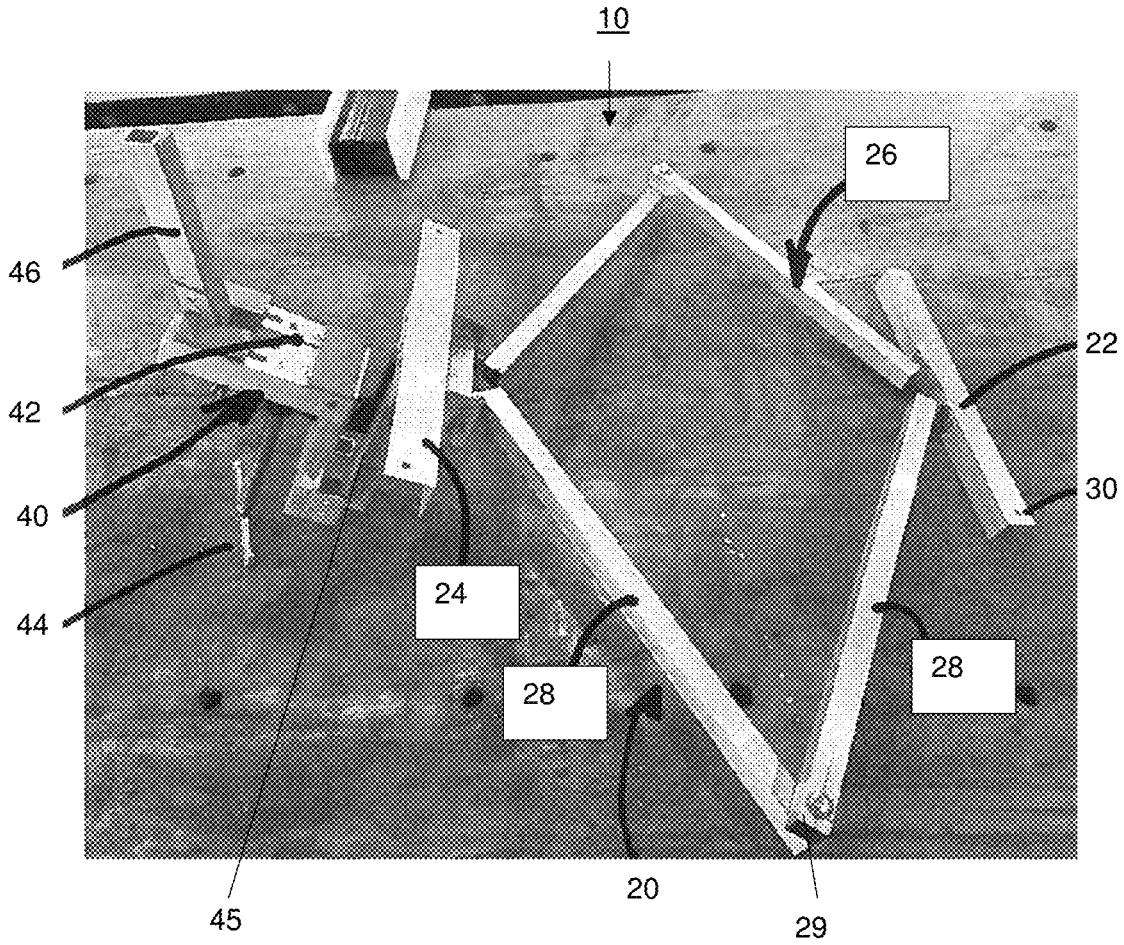
FIG. 1 is a top side perspective view of the gutter hanging tool of the inventive concept.
Figure 4:
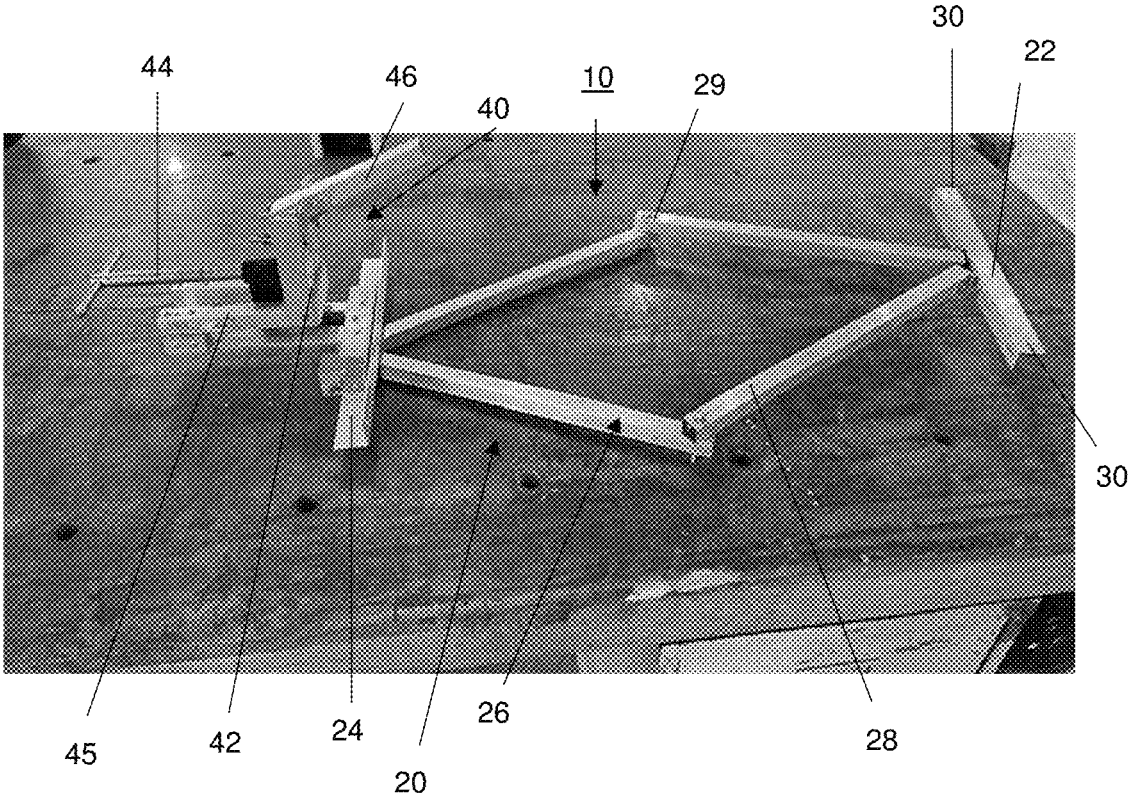
FIG. 4 is a second top side perspective view of the FIG. 1 tool.
Figure 5:
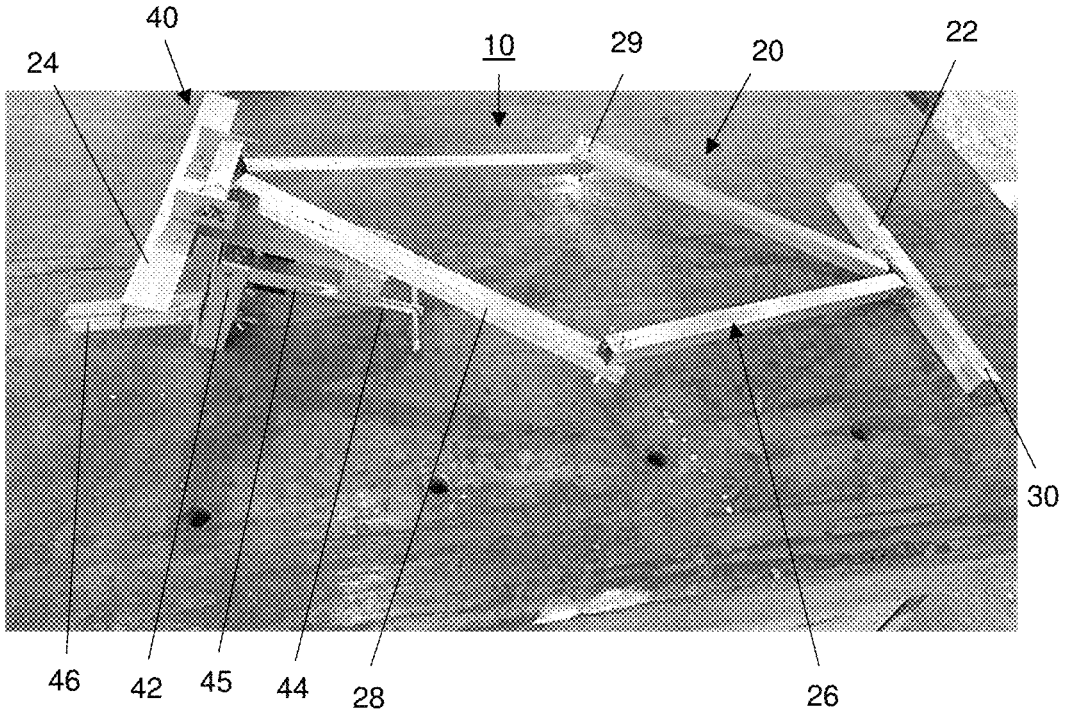
FIG. 5 is a third top side perspective view of the FIG. 1 tool.

Referring initially to FIGS. 1, 4 and 5, moving approximately from right to left in the figures, the tool 10 has a grasping portion 20 for securing the tool to the building where the gutter is being installed and a gutter support portion 40. The grasping portion 20 may be characterized by a first and a second fin or blade 22, 24. In many instances, the eave of the roof has a soffit material installed, with the soffit panels secured in place by a channel that is attached to the home. The first fin 22 is depicted here as a length of angle stock, with a horizontal portion of the angle stock facing towards the building, for insertion into the channel. If the channel is not present, the horizontal portion of the first fin 22 may bear against a vertical face of a wall/siding. The second fin 24 may be arranged parallel to the first fin 22, so that the respective vertical portions face each other. The second fin 24 may also comprise a length of angle stock. A horizontal portion of the second fin 24 may be inserted into a channel under the fascia to secure the outer edge of the soffit, if that channel is present. If it is not present, the horizontal portion of the second fin 24 may bear against a vertical face of the fascia. Mounted between the respective fins may be a scissors mechanism 26. Depending upon the lengths of the arms 28 of this scissors mechanism 26, the tool 10 may be adjusted to be mounted in a wide range of distances between the building and the fascia. This manner of mounting may be achieved without using fasteners. This may also provide easy mounting and dismounting. The scissors mechanism 26 may comprise one or more nut and bolt pairs or the like configured to allow a user to permit or restrict motion of the arms 28. For example, by way of illustration and not limitation, a wing nut and bolt may be positioned at an elbow 29 of the scissors mechanism 26, where the elbow 29 may comprise a connection between a portion of a first arm 28 and a portion of a second arm 28 in rotational communication with the first arm 28. The wing nut may be loosened along the bolt to permit motion of the arms 28, allowing the tool 10 to be adjusted to be mounted at any number of distances between the building and the fascia. Furthermore, the wing nut may be tightened along the bolt to restrict motion of the arms 28, allowing the tool to be secured to be mounted at a fixed distance between the building and the fascia. In other embodiments, notches or abrasive material may be present where surfaces of the arms 28 connect with one another to secure the arms 28 in place. It will be apparent to one of ordinary skill in the art that there may be any number of different methods and/or materials available for adjusting and securing exemplary arms of an exemplary scissors mechanism without departing from the scope of the present invention.

Some buildings and homes have wooden soffits. The fins 22, 24 may be provided with eyelets 30 to permit installation of the tool 10 on wood with screws, as seen in the figures. There will simply be a small hole in the wooden soffit to repair afterwards. It will be apparent to one of ordinary skill in the art that there may be any number of different methods and/or materials available for securing an exemplary fin to a fascia, soffit, wall, some combination thereof, or the like without departing from the scope of the present invention.

The support portion 40 of the tool may be attached to or integral with the second fin 24 and extend outwardly therefrom in the direction opposite to the scissors mechanism 26. The support portion 40 is depicted in FIG. 1 in its useful position, that is, a position where it presents a platform 42 on which a portion of a length of gutter may be supported and held against the fascia for connection. The connection is usually effected by conventional gutter hangers, which are outside the scope of the inventive concept. Adjustment of the platform along the horizontal length ("x axis") of the fascia may be achieved by loosening and tightening the scissors mechanism. The adjustment along this axis generally requires the least amount of fine adjustment.

Once the tool 10 is secured in place to the building, the platform 42 may be adjusted in the dimension transverse ("y axis" or height) to the fascia, as well as in the dimension normal ("z axis") to the fascia surface. Of these, the dimension considered more important is the height or y axis dimension. Adjusting the height of the gutter allows it to have an appropriate grade for water evacuation to a downspout before it is attached to the home. Some eaves are not level horizontally, and may have differing angles. Adjustment in the height dimension is achieved with a hand screw 44, located below the platform 42. By way of example and not limitation, rotation of the hand screw 44 in a first direction may permit the platform 42 to be mobile along a vertical adjustment member 45 in the y axis direction, and rotation of the hand screw 44 in a second direction substantially opposite of the first direction may cause the platform 42 to be secured relative to the vertical adjustment member 45. In this particular embodiment, the vertical adjustment member 45 and the hand screw 44 collectively define a height adjustment apparatus. Rough adjustment may be performed before the length of gutter is placed on the platform 42, with fine adjustment preferably occurring after the gutter is positioned on the platform 42. When the fine adjustment occurs at one point along the length of gutter, it is preferred that the remainder of the gutter is supported, either by further tools 10 or by being directly secured to the fascia.

An adjustable upright bar 46 may be used to securely position the gutter in any number of different positions across the z axis. This is in many cases a rough adjustment, as a major factor in the adjustment may involve the transverse width of the gutter being used and the specific type of gutter hanger being used.

The depicted embodiment of the tool 10 is assembled primarily from aluminum members, for a variety of reasons, including its density, cost and corrosion resistance. An appropriate thermoplastic material might also be acceptable. It will be apparent to one of ordinary skill in the art that any number of different materials and/or combinations thereof may be employed to assemble features of an exemplary tool without departing from the scope of the present invention.

Figure 2:
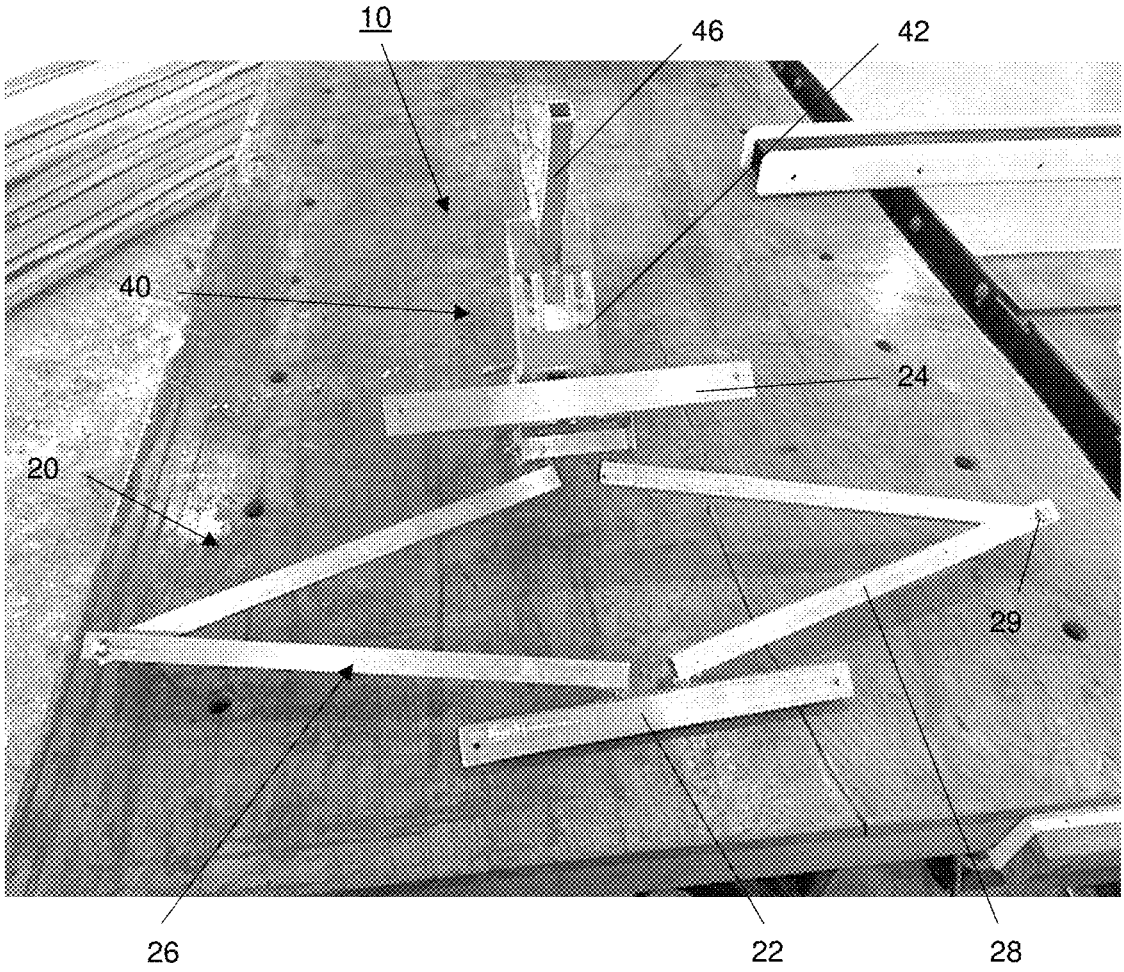
FIG. 2 is a top rear perspective view of the FIG. 1 tool.
Figure 3:
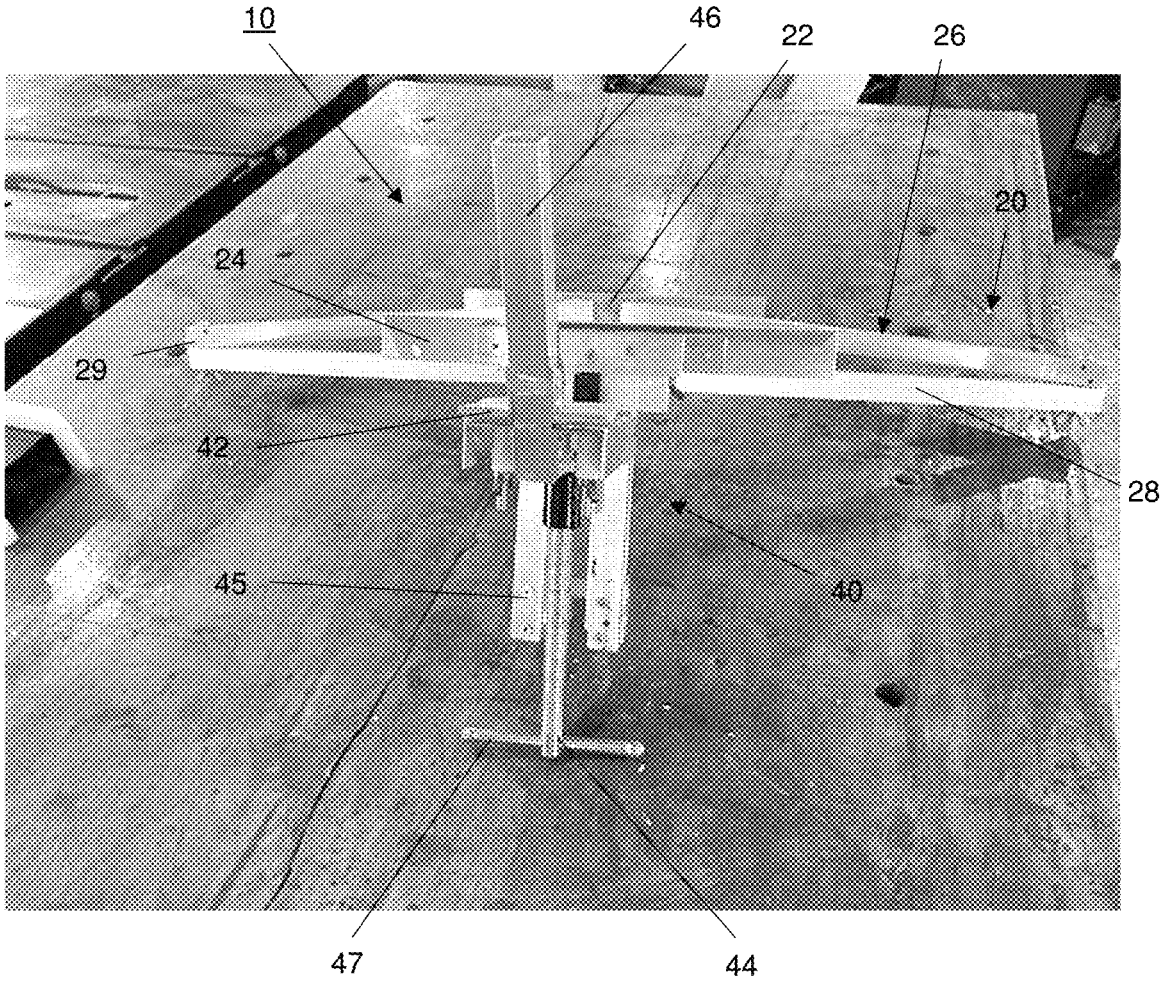
FIG. 3 is a front elevation view of the FIG. 1 tool.

Referring now to FIGS. 2-3, various views of the tool 10 comprising the support portion 40 and the grasping portion 20 having fins 22, 24 and a scissors mechanism 26 defined by arms 28 pivotally connected at elbows 29 are shown. Here, the adjustable upright bar 46 of the tool 10 comprises a lightweight, rigid, elongate member adapted to be repositioned across any number of different positions across the z axis of the support portion 40. Specifically, in the embodiment shown, the adjustable upright bar 46 may be positioned at various locations across the platform 42 in the z axis direction. By way of example and not limitation, repositioning may occur based on rotation of the adjustable upright bar 46 about a pivot point connection between the adjustable upright bar 46 and the platform 42. As another non-limiting example, repositioning may occur by detaching the adjustable upright bar 46 from one or more first connection points with respect to the platform 42, and thereafter reattaching the adjustable upright bar 46 to one or more second connection points. Although a lightweight, rigid, elongate member defining an adjustable upright bar is shown and described, it will be apparent to one of ordinary skill in the art that there may any number of different horizontal gutter positioning apparatuses available for securing the gutter in any number of different positions across the z axis. Rotation of the hand screw 44 to permit or restrict vertical movement of the platform 42 with respect to the vertical adjustment member 45 may be substantially enabled by a handle 47 of the hand screw 44. By way of example and not limitation, a user may place a hand on the handle 47, and apply force to the handle 47 to generate torque causing the hand screw 44 to rotate.

Referring now to FIGS. 6-7, various views of the tool 10 comprising the support portion 40 having an adjustable upright bar 46, platform 42, vertical adjustment member 45 and hand screw 44 (and handle 47 thereof), and the grasping portion 20 having fins 22, 24, and a scissors mechanism 26 defined by arms 28 pivotally connected at elbows 29 are shown. Here, the tool 10 is shown in an outdoor installation setting 60, where a gutter 52 is being installed at an eave 62 partially defined by an edge of a roof 64. Here, the gutter 52 is positioned above the platform 42 between the adjustable upright bar 46 and the second fin 24. The first fin 22 may be adapted to be secured to a wall/siding 58 at a first end of a soffit 54. The second fin 24 may be adapted to be secured to a fascia 56 at a second end of the soffit 54 substantially opposite of the first end. It will be apparent to one of ordinary skill in the art that there may be any number of different methods or devices available for securing a fin in proximity to a soffit without departing from the scope of the present invention.

While a gutter installation tool has been described with reference to various embodiments, those skilled in the art will understand that various changes may be made, and equivalents may be substituted for elements thereof without departing from the scope and essence of the disclosure. In addition, many modifications may be made to adapt a particular situation or material to the teachings of the disclosure without departing from the essential scope thereof. Therefore, it is intended that a gutter installation tool device and its corresponding method not be limited to the particular embodiments disclosed. All citations referred to herein are expressly incorporated herein by reference.

What is claimed is:

1. A device for installing a length of rain gutter, the device comprising:

a grasping portion comprising:

a first fin and a second fin; and a scissors apparatus positioned between the first fin and the second fin, the scissors apparatus comprising a plurality of arms in rotational communication with one another;

wherein the scissors apparatus is configured to permit the first and second fins to be positioned at any number of lengths from one another to immobilize the grasping portion beneath an eave;

a support portion comprising:

a platform;

a horizontal gutter positioning apparatus; and a height adjustment apparatus;

wherein the support portion is linked to and configured to extend outwardly from the grasping portion away from the scissors apparatus;

wherein the height adjustment apparatus is configured to allow the height of the platform and the horizontal gutter positioning apparatus to be adjusted; and wherein the platform and horizontal gutter positioning apparatus are configured to contact and immobilize the length of rain gutter.

2. The device of claim 1, wherein:

the scissors apparatus comprises four arms of substantially equal length.

3. The device of claim 1, wherein:

at least one selected from the group of the first fin and the second fin comprises a length of angle stock.

4. The device of claim 1, further comprising:

a nut and bolt pair, configured to connect a first arm of the scissors apparatus to a second arm of the scissors apparatus, and adapted to permit the first arm and second arm to rotate with respect to one another.

5. The device of claim 4, wherein:

the nut is a wing nut.

6. The device of claim 1, wherein:

the first fin further comprises at least one eyelet adapted to receive a fastener.

7. The device of claim 1, further comprising:

a hand screw, adapted to be rotated in a first direction to permit the platform to be adjusted between a number of different heights, and adapted to be rotated in a second direction substantially opposite of the first direction to restrict the platform from moving between a number of different heights.

8. The device of claim 1, wherein:

the horizontal gutter positioning apparatus comprises an adjustable upright bar.

9. The device of claim 8, wherein:

the adjustable upright bar is adapted to rotate about a connection point between the adjustable upright bar and the platform.

10. The device of claim 1, wherein:

the device comprises an amount of aluminum.

11. The device of claim 1, wherein:

the device comprises an amount of thermoplastic material.

12. A method for installing a length of rain gutter, the method comprising:

securing a grasping portion of a device for installing a length of rain gutter beneath an eave, the grasping portion comprising a first fin, a second fin, and a scissors apparatus positioned between the first fin and the second fin, the scissors apparatus having a plurality of arms in rotational communication with one another, wherein securing the grasping portion comprises:

positioning the scissors apparatus to connect the first fin to a vertical wall and the second fin to a fascia;

positioning a portion of the length of rain gutter within a support portion of the device for installing a length of rain gutter, the support portion comprising a platform, a horizontal gutter positioning apparatus, and a height adjustment apparatus, wherein the support portion is linked to and configured to extend outwardly from the grasping portion away from the scissors apparatus, wherein the height adjustment apparatus permits the platform and horizontal gutter positioning apparatus to be positioned at any number of heights;

immobilizing the length of rain gutter within the support portion by maintaining the portion of the length of the rain gutter between the platform, the positioning apparatus, and the fascia; and attaching the length of rain gutter to the eave.

13. The method of claim 12 further comprising:

securing a grasping portion of a second device for installing a length of rain gutter beneath the eave, wherein the second device is substantially identical to the device of claim 12.

14. The method of claim 12 further comprising:

providing a nut and bolt pair, and configuring the nut and bolt pair to connect a first arm of the scissors apparatus to a second arm of the scissors apparatus.

15. The method of claim 12 further comprising:

providing four arms of substantially equal length to define the scissors apparatus.

16. The method of claim 12 further comprising:

providing an adjustable upright bar to define the horizontal gutter positioning apparatus.

17. The method of claim 16 further comprising:

configuring the adjustable upright bar to be able to rotate about a connection point between the adjustable upright bar and the platform.

18. A device for installing a length of rain gutter, the device comprising:

a grasping portion comprising:

a first fin and a second fin, each comprising a length of angle stock; and a scissors apparatus positioned between the first fin and the second fin, the scissors apparatus comprising a plurality of arms each of substantially equivalent length in rotational communication with one another;

wherein the scissors apparatus is configured to permit the first and second fins to be positioned at any number of lengths from one another to immobilize the grasping portion beneath an eave;

wherein each of the first fin, the second fin, and the plurality of arms comprise aluminum;

a support portion comprising:

a platform;

a horizontal gutter positioning apparatus; and a height adjustment apparatus, including a hand screw;

wherein the support portion is linked to and adapted to extend outwardly from the grasping portion away from the scissors apparatus;

wherein the height adjustment apparatus is configured to allow the height of the platform and the horizontal gutter positioning apparatus to be adjusted by rotation of the hand screw; and wherein the platform and horizontal gutter positioning apparatus are configured to contact and immobilize the length of rain gutter.

* * * * *